US011848133B2

(12) United States Patent
Misawa et al.

(10) Patent No.: US 11,848,133 B2
(45) Date of Patent: Dec. 19, 2023

(54) MAGNETIC BASE BODY, COIL COMPONENT, AND CIRCUIT BOARD

(71) Applicant: TAIYO YUDEN CO., LTD., Tokyo (JP)

(72) Inventors: Kazuki Misawa, Takasaki (JP); Takashi Nakajima, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 4 days.

(21) Appl. No.: 17/672,575

(22) Filed: Feb. 15, 2022

(65) Prior Publication Data

US 2022/0293316 A1 Sep. 15, 2022

(30) Foreign Application Priority Data

Mar. 12, 2021 (JP) ..... 2021-039963

(51) Int. Cl.
*H01F 1/33* (2006.01)
*H01F 1/147* (2006.01)
*H01F 27/255* (2006.01)

(52) U.S. Cl.
CPC ..... *H01F 1/33* (2013.01); *H01F 1/14766* (2013.01); *H01F 27/255* (2013.01)

(58) Field of Classification Search
CPC ..... H01F 1/14766; H01F 1/24; H01F 1/33; H01F 17/0013; H01F 17/045; H01F 2017/048; H01F 27/255
See application file for complete search history.

(56) References Cited

U.S. PATENT DOCUMENTS

2016/0293321 A1* 10/2016 Takeoka ..... H01F 1/14
2020/0277689 A1* 9/2020 Orimo ..... B22F 1/142

FOREIGN PATENT DOCUMENTS

JP 2015126047 A 7/2015
JP 2020053542 A 4/2020

* cited by examiner

*Primary Examiner* — Jenny R Wu
(74) *Attorney, Agent, or Firm* — Law Office of Katsuhiro Arai

(57) ABSTRACT

A magnetic base body is constituted by: metal magnetic grains containing Fe, and Si as an optional component, where the total content of the Fe and Si is 99% by mass or higher; and oxide layers present between the metal magnetic grains; wherein the ratio ($I_{Fe2SiO4}/I_{Fe}$) of the strongest diffraction line intensity ($I_{Fe2SiO4}$) observed in a range of 30.8°≤2θ≤32.2° to the strongest diffraction line intensity ($I_{Fe}$) observed in a range of 43.8°≤2θ≤45.2° in X-ray diffraction measurement using the CuKα ray is 0.0020 or higher; and the ratio ($I_{Fe2O3}/I_{Fe}$) of the strongest diffraction line intensity ($I_{Fe2O3}$) observed in a range of 33.0°≤2θ≤34.4° to the $I_{Fe}$ in X-ray diffraction measurement using the CuKα ray is lower than 0.0010.

7 Claims, 5 Drawing Sheets

Cross-section C-C

MAGNETIC BASE BODY, COIL COMPONENT, AND CIRCUIT BOARD

CROSS-REFERENCE TO RELATED APPLICATIONS

The present application claims priority to Japanese Patent Application No. 2021-039963, Mar. 12, 2021, the disclosure of which is incorporated herein by reference in its entirety including any and all particular combinations of the features disclosed therein.

BACKGROUND

Field of the Invention

The present invention relates to a magnetic base body, a coil component, and a circuit board.

Description of the Related Art

In recent years, the drive for smaller, higher-performance mobile phones and other high-frequency communication systems calls for size reduction and performance enhancement of electronic components installed therein. In coil components such as inductors, achievement of high current flow is one guiding principle for performance enhancement. To meet these demands for size reduction and high current flow, magnetic base bodies formed by metal magnetic materials that are more resistant to magnetic saturation than are ferrite materials, are finding applications as magnetic base bodies for use in coil components.

Metal magnetic materials are inferior to ferrite materials in electrical insulating property, so when they are used, in order to obtain a magnetic base body offering sufficient electrical insulating property, oftentimes insulating layers are formed on the surface of grains formed by the metal magnetic materials to electrically insulate the grains from each other.

In Patent Literature 1, for example, an Si compound is placed on the surface of metal magnetic grains constituting a soft magnetic alloy powder of Fe-3.5% Si-4.0% Cr (Si: 3.5%, Cr: 4.0%, and Fe and unavoidable impurities: the remainder) based on percent by mass, so that when compacted and then heat-treated in air, the metal magnetic grains will be bonded to each other through an insulating oxide phase.

Also, in Patent Literature 2, soft magnetic metal grains having a composition of Fe—Si—Cr (Fe: 95% by weight, Si: 3.5% by weight, Cr: 1.5% by weight) are compacted and then heat-treated in atmosphere and also in an atmosphere of a different oxygen concentration, including an ultralow oxygen concentration atmosphere of 3 ppm or lower in oxygen concentration, to obtain a highly-insulating magnetic base body that contains magnetite and hematite at a specific ratio.

BACKGROUND ART LITERATURES

[Patent Literature 1] Japanese Patent Laid-open No. 2015-126047

[Patent Literature 2] Japanese Patent Laid-open No. 2020-53542

SUMMARY

When an insulating layer is formed by heat treatment in air or other high oxygen concentration atmosphere, as in Patent Literature 1, the components constituting the metal magnetic grains actively undergo oxidation reaction and the amount of oxide between the metal magnetic grains tends to increase. This, as a result, can cause the percentage of metal magnetic grains in the magnetic base body to decrease and its specific magnetic permeability and other magnetic properties to drop.

Also, when the magnetic metal grains (soft magnetic metal grains) are electrically insulated from each other with an insulating film containing magnetite and hematite, as in Patent Literature 2, the volume resistivity of the magnetic base body can drop, even when it is constituted by a relatively high percentage of hematite which is considered to have high electrical insulating property.

In light of the above, an object of the present invention is to provide a magnetic base body constituted by metal magnetic grains and offering excellent electrical insulating property.

After conducting various studies to solve the aforementioned problems, the inventor of the present invention found that the aforementioned problems could be solved by a magnetic base body presenting a peak observed in a range of $30.8° \leq 2\theta \leq 32.2°$ but no peak observed in a range of $33.0° \leq 2\theta \leq 34.4°$ in X-ray diffraction measurement using the CuKα ray, which would be obtained by subjecting a compact constituted by metal magnetic grains containing high percentages of Fe and Si, as well as by a resin, to degreasing treatment in an oxygen-containing atmosphere whose oxygen concentration is lower than that in air, and subsequently to heat treatment in an atmosphere where oxygen is virtually nonexistent, and eventually completed the present invention.

To be specific, the first aspect of the present invention to solve the aforementioned problems is a magnetic base body formed by: metal magnetic grains containing Fe, and Si as an optional component, where the total content of the Fe and Si is 99% by mass or higher; and oxide layers present between the metal magnetic grains; wherein the ratio ($I_{Fe2SiO4}/I_{Fe}$) of the strongest diffraction line intensity ($I_{Fe2SiO4}$) observed in a range of $30.8° \leq 2\theta \leq 32.2°$ to the strongest diffraction line intensity ($I_{Fe}$) observed in a range of $43.8° \leq 2\theta \leq 45.2°$ in X-ray diffraction measurement using the CuKα ray is 0.0020 or higher; and the ratio ($I_{Fe2O3}/I_{Fe}$) of the strongest diffraction line intensity ($I_{Fe2O3}$) observed in a range of $33.0° \leq 2\theta \leq 34.4°$ to the $I_{Fe}$ in X-ray diffraction measurement using the CuKα ray is lower than 0.0010.

Also, the second aspect of the present invention is a coil component comprising the magnetic base body pertaining to the aforementioned first aspect.

Furthermore, the third aspect of the present invention is a circuit board on which the coil component pertaining to the aforementioned second aspect is mounted.

According to the present invention, a magnetic base body constituted by metal magnetic grains and offering excellent electrical insulating property can be provided.

BRIEF DESCRIPTION OF THE DRAWINGS

(FIG. 4A: General perspective view, FIG. 4B: View of cross-section C-C in FIG. 4A)

(FIG. 6A: General perspective view, FIG. 6B: View of cross-section D-D in FIG. 6A)

DESCRIPTION OF THE SYMBOLS

Figure 1:
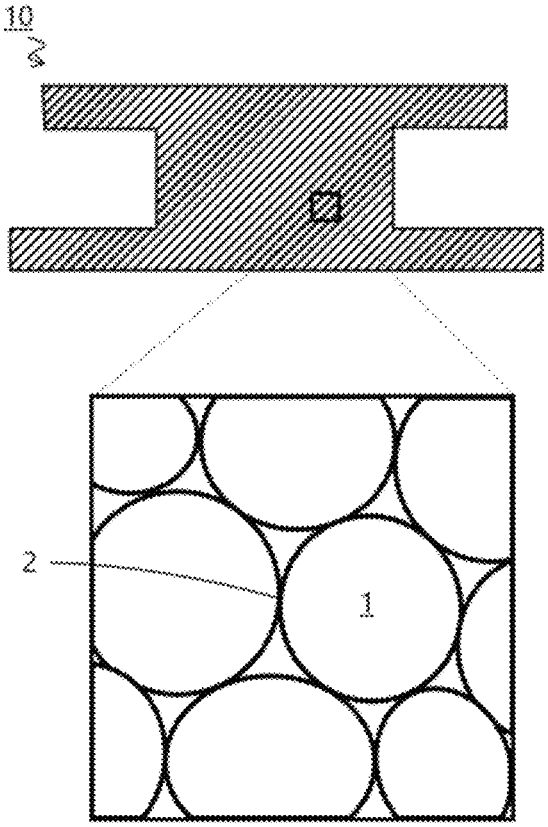
FIG. 1 is a schematic drawing showing the structure of the magnetic base body pertaining to the first aspect of the present invention.

100 Coil component
10 Magnetic base body (powder magnetic core)
1 Metal magnetic grain
2 Oxide layer
2*a* First region
2*b* Second region
20 Conductor
A, B End point of target line segment for analysis

DETAILED DESCRIPTION OF EMBODIMENTS

The constitutions as well as operations and effects of the present invention are explained below, together with the technical ideas, by referring to the drawings. It should be noted, however, that the mechanisms of operations include estimations, and whether they are correct or incorrect does not limit the present invention in any way.

[Magnetic Base Body]

As shown schematically in FIG. 1, the magnetic base body 10 pertaining to the first aspect of the present invention (hereinafter also referred to simply as "first aspect") is formed by: metal magnetic grains 1 containing Fe, and Si as an optional component, where the total content of the Fe and Si is 99% by mass or higher; and oxide layers 2 present between the metal magnetic grains 1.

The metal magnetic grains 1 contain Fe as an essential component. Because the metal magnetic grains 1 contain Fe, the magnetic base body 10 can have high magnetic permeability and saturated magnetic flux density. The content of Fe in the metal magnetic grains 1 is not limited in any way so long as a magnetic base body 10 having the desired properties can be obtained. The higher the content of Fe, the higher the magnetic permeability and saturated magnetic flux density to be obtained, and therefore the content of Fe is preferably 90% by mass or higher, or more preferably 93% by mass or higher, or yet more preferably 95% by mass or higher. On the other hand, from the viewpoint of inhibiting magnetic properties from dropping due to oxidation of Fe or generation of eddy current, the content of Fe is preferably 99% by mass or lower, or more preferably 98% by mass or lower.

Also, the metal magnetic grains 1 may contain Si as an optional component. When the metal magnetic grains 1 contain Si, the electrical resistance increases and drop in magnetic properties due to eddy current can be inhibited. If the metal magnetic grains 1 contain Si, its content is not limited in any way so long as a magnetic base body 10 having the desired properties can be obtained. From the viewpoint of fully demonstrating the effect of inhibiting eddy current, the content of Si is preferably 1% by mass or higher, or more preferably 1.5% by mass or higher. On the other hand, from the viewpoint of increasing the content of Fe in the metal magnetic grains 1 to achieve excellent magnetic properties, the content of Si is preferably 7% by mass or lower, or more preferably 5% by mass or lower.

The metal magnetic grains 1 are such that Fe, which is an essential component, and Si, which is an optional component, represent 99% by mass or more in total content. Here, "total content" means percent relative to the total mass of metal elements and Si. When Fe and Si account for 99% by mass or more of the metal elements and Si constituting the metal magnetic grains 1, the magnetic base body 10 can have excellent magnetic properties. In this respect, preferably the total content of Fe and Si is 99.5% by mass or higher. The upper-limit value of the total content of Fe and Si is not limited, and it may be 100% by mass, that is, the metal magnetic grains may comprise substantially Fe alone, or substantially solely Fe and Si. Here, "comprise substantially Fe alone, or substantially solely Fe and Si" means that the metal magnetic grains do not contain impurities in amounts exceeding the total amount of any components (unavoidable impurities) other than Fe and Si that may be found in sufficiently pure materials normally available as Fe powders or Fe—Si powders, and unavoidable impurities that could mix in during normal manufacturing processes for magnetic base bodies. Also, the total content of Fe and Si represents percentage by mass as measured and calculated according to the method described below. It should be noted, however, that, if the composition of the metal magnetic powder used in the manufacture of the magnetic base body 10 has been reported based on the result of a highly accurate analysis conducted by the reliable manufacturer of the powder, etc., and if there is no special reason to vary the internal composition of each metal magnetic grain 1 made from the metal magnetic powder during the manufacturing process for the magnetic base body 10, then the reported composition of the metal magnetic powder may be used as the composition of the metal magnetic grains 1. It should be noted that, in any manufacturing process without special process adopted for the magnetic base body 10, the internal composition of the metal magnetic grains 1 normally matches the composition of the metal magnetic powder used as the material.

The metal magnetic grains 1 may contain elements other than Fe and Si to the extent that the object of the present invention can be achieved. In this case, preferably the mass percentage of the elements other than Fe and Si is lower than the mass percentage of Si, from the viewpoint of achieving excellent magnetic properties. Examples of elements that may be contained include Cr, Al, Ni, Ti, Zr, etc.

In the magnetic base body 10, oxide layers 2 are present between adjacent metal magnetic grains 1. The adjacent metal magnetic grains 1 are electrically insulated from each other by these oxide layers 2. Also, the oxide layers 2 contribute to shape retention, and manifestation of mechanical strength, of the magnetic base body 10 by joining the metal magnetic grains 1 together.

Preferably the oxide layers 2 have first regions 2*a* where the molar ratio of Si to Fe (Si/Fe) is 2 or higher, and second regions 2*b* where the molar ratio (Si/Fe) is 1 or lower. This way, the electrical insulating property of the magnetic base body 10 improves further. Although the upper-limit value of Si/Fe in the first regions and lower-limit value of Si/Fe in the second regions are not limited, the Si/Fe in the first regions is generally 4 or lower, while the Si/Fe in the second regions is generally 0.3 or higher, in a magnetic base body 10 obtained through any normally adopted manufacturing process. While the reason is not clear as to why excellent electrical insulating property will manifest when the oxide layers 2 include the first regions 2*a* and second regions 2*b*, it is likely due to the functional mechanism below.

In the first regions 2*a*, the volume resistivity becomes extremely high due to the presence of oxides that have high content percentage of Si, exhibiting excellent insulating property. The electrical resistance of the magnetic base body 10 is understood to be the result of connecting the resistances of the metal magnetic grains 1, resistances of the first regions 2*a*, and resistances of the second regions 2*b*, in series. Accordingly, the presence of the first regions 2*a* where the volume resistivity is extremely high contributes to improvement of the electrical resistance of the magnetic base body 10 as a whole. In other words, local improvements in electrical insulating property that occur because differences in the molar ratio (Si/Fe) exist within the oxide layers 2, will have a ripple effect on the magnetic base body 10 as a whole and bring its electrical insulating property to exceed what is expected when the molar ratio (Si/Fe) is constant. In the sense that it will achieve a marked effect on improving electrical insulating property, preferably areas where the molar ratio (Si/Fe) is 3 or higher are present in the first regions 2*a*.

Figure 3:
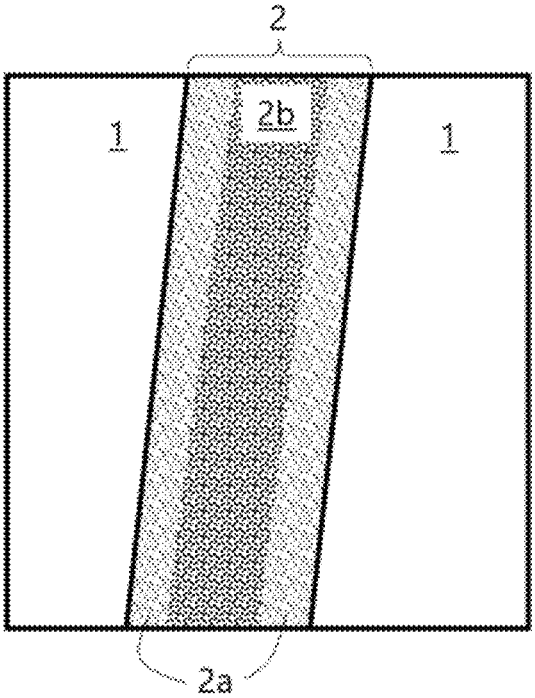
FIG. 3 is a schematic drawing showing a preferred oxide layer structure in the magnetic base body pertaining to the first aspect of the present invention.

When the oxide layers 2 have first regions 2*a* and second regions 2*b*, more preferably the first regions 2*a* are present as layers in a manner sandwiching a second region 2*b* in a direction in which the magnetic grains face each other, as shown in FIG. 3. This increases the percentage, in the oxide layers 2, of the regions where the volume resistivity is extremely high, which further improves the electrical insulating property of the magnetic base body 10.

Here, the aforementioned composition of the metal magnetic grains 1, and distribution of molar ratios of Si to Fe (Si/Fe) for determining whether or not first regions 2*a* and second regions 2*b* are present in the oxide layers 2, are respectively determined according to the procedures below.

Figure 2:
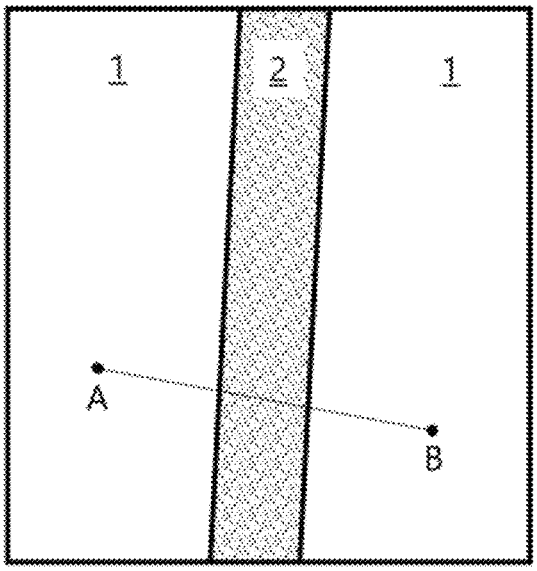
FIG. 2 is an explanation drawing showing how the composition of the metal magnetic grains and distribution of molar ratios of Si to Fe (Si/Fe) in the oxide layers, in the magnetic base body pertaining to the first aspect of the present invention, are determined.

First, a thin sample with a thickness of approx. 50 nm to 100 nm is taken out from the center part of the magnetic base body 10 using a focused ion beam (FIB) system, and then immediately placed in a scanning transmission type electron microscope (STEM) equipped with an annular dark-field detector and an energy-dispersive X-ray spectroscopy (EDS) detector. Next, the thin sample is observed with the STEM to identify, based on contrast (brightness) difference, a grain boundary part where metal magnetic grains 1 are contacting each other via an oxide layer 2, as schematically shown in FIG. 2. Next, in the identified grain boundary part, line analysis is performed with the EDS along line segment AB extending from arbitrary point A inside one metal magnetic grain 1, through the oxide layer 2, to arbitrary point B inside the other metal magnetic grain 1. Regarding the conditions for EDS measurement, the acceleration voltage is 200 kV, electron beam diameter is 1.0 nm, and measurement time is set so that the integral value of signal intensities in a range of 6.22 keV to 6.58 keV at the respective points inside the metal magnetic grains 1 gives a count of 25 or higher. Also, the measurement points are spaced at substantially constant intervals in a manner that the number of measurement points in the oxide layer 2 becomes at least 10. Next, the ratio ($I_{OK\alpha}/I_{M(total)}$) of the signal intensity of the OKα ray ($I_{Ok\alpha}$) to the total sum of the signal intensities ($I_{M(total)}$), each indicating the highest intensity, of the characteristic X rays of the metal elements detected, is calculated for each measurement point. If Fe and Cr have been detected as metal elements, for example, the ratio ($I_{OK\alpha}/(I_{FeK\alpha}+I_{CrK\alpha})$) of the signal intensity of the OKα ray to the total sum of the signal intensity of the Kα ray ($I_{FeK\alpha}$) indicating the highest intensity among the characteristic X rays of Fe and the signal intensity of the Kα ray ($I_{CrK\alpha}$) indicating the highest intensity among the characteristic X rays of Cr, is calculated as ($I_{OK\alpha}/I_{M(total)}$). Then, it is considered that those regions where this value is 0.5 or greater represent the oxide layer 2, while other regions where the value is smaller than 0.5 represent the metal magnetic grain 1. Next, for the regions that are considered the metal magnetic grain 1, the percentages of elements at each measurement point are calculated in % by mass and, among any three successive measurement points where the content percentage of each of the elements varies by no more than ±1% by mass, one closest to the oxide layer 2 is selected, and the average value of the content percentage of each element there is calculated and used as the composition of the metal magnetic grain 1. Also, the atomic percentage (% by atom) of each element, and the molar ratio of Si to Fe (Si/Fe) based thereon, are each calculated at each measurement point positioned in the regions that are considered the oxide layer 2, to obtain the Si/Fe distribution in the oxide layer 2.

The magnetic base body 10 is such that the ratio ($I_{Fe2SiO4}/I_{Fe}$) of the strongest diffraction line intensity ($I_{Fe2SiO4}$) observed in a range of $30.8° \leq 2\theta \leq 32.2°$ to the strongest diffraction line intensity ($I_{Fe}$) observed in a range of $43.8° \leq 2\theta \leq 45.2°$ in X-ray diffraction measurement at a randomly selected surface of the magnetic base body using the CuKα ray is 0.0020 or higher, and also the ratio ($I_{Fe2O3}/I_{Fe}$) of the strongest diffraction line intensity ($I_{Fe2O3}$) observed in a range of $33.0° \leq 2\theta \leq 34.4°$ to the strongest diffraction line intensity $I_{Fe}$ observed in a range of $43.8° \leq 2\theta \leq 45.2°$ is lower than 0.0010. It should be noted that, if the value of $I_{Fe2O3}/I_{Fe}$ is lower than 0.0010, normally any diffraction line intensity ($I_{Fe2O3}$) observed in a range of $33.0° \leq 2\theta \leq 34.4°$ is of noise level and not recognized as a peak under X-ray diffraction patterns. The strongest diffraction line of $Fe_2SiO_4$ is observed in a range of $30.8° \leq 2\theta \leq 32.2°$. Accordingly, the fact that $I_{Fe2SiO4}/I_{Fe}$ is 0.0020 or higher means the strongest diffraction line of $Fe_2SiO_4$ has manifested as a peak and the magnetic base body 10 contains $Fe_2SiO_4$. On the other hand, the strongest diffraction line of $Fe_2O_3$ is observed in a range of $33.0° \leq 2\theta \leq 34.4°$. Accordingly, the fact that $I_{Fe2O3}/I_{Fe}$ is lower than 0.0010 means the strongest diffraction line of $Fe_2O_3$ has not manifested as a peak and the magnetic base body 10 contains hardly any $Fe_2O_3$.

A magnetic base body 10 demonstrates excellent electrical insulating property when its $I_{Fe2SiO4}/I_{Fe}$ and $I_{Fe2O3}/I_{Fe}$ are in the aforementioned ranges. While the reason for this is not clear, it is likely due to the functional mechanism below.

If oxides of Fe are contained in the oxide layers 2 of the magnetic base body 10, oftentimes hematite ($Fe_2O_3$) and magnetite ($Fe_3O_4$) are in a state of coexistence. In hematite, the valency of Fe is +3 and stable, which means that electron conduction associated with Fe valency fluctuation seldom occurs when hematite exists by itself. When hematite coexists with magnetite, however, magnetite in which Fe exists in a +2 or +3 state triggers Fe valency fluctuation to also occur in hematite, thereby causing the insulating property to drop due to electron conduction. This is presumably the cause of lower volume resistivity in a magnetic base body 10 whose content percentage of hematite is relatively high, as mentioned above. By contrast, in the oxide layers 2 of a magnetic base body 10 whose $I_{Fe2SiO4}/I_{Fe}$ is high and $I_{Fe2O3}/I_{Fe}$ is low, Fe forms fayalite ($Fe_2SiO_4$) together with Si and seldom exists as standalone oxides such as hematite or magnetite. Accordingly, the aforementioned Fe valency fluctuation and electron conduction associated therewith do not occur, and high electrical insulating property can be achieved as a result. It should be noted that, in X-ray diffraction measurement using the CuKα ray, the strongest diffraction line intensity $I_{Fe}$ observed in a range of 43.8°≤2θ≤45.2° corresponds to the strongest diffraction line intensity of α-Fe which is the primary component of the metal magnetic grains 1. Also, the strongest diffraction line intensity $I_{Fe2SiO4}$ observed in a range of 30.8°≤2θ≤32.2°, and the strongest diffraction line intensity $I_{Fe2O3}$ observed in a range of 33.0°≤2θ≤34.4°, correspond to the strongest diffraction line intensities of fayalite and hematite, respectively. Since $I_{Fe}$ is virtually unaffected by the types and content percentages of the oxides constituting the oxide layers 2, the percentages of fayalite and hematite contained in the oxide layers 2 can be obtained roughly with quantitative accuracy based on the values of the ratios of $I_{Fe2SiO4}$ and $I_{Fe2O3}$ relative to $I_{Fe}$.

Preferably the value of the $I_{Fe2SiO4}/I_{Fe}$ is 0.0025 or greater in that the magnetic base body 10 will have superior electrical insulating property. Also, preferably the value of the $I_{Fe2SiO4}/I_{Fe}$ is 0.0032 or greater in that the magnetic base body 10 will have significantly high mechanical strength. Although the upper-limit value of the $I_{Fe2SiO4}/I_{Fe}$ is not limited, preferably it is 0.0035 or smaller in that the percentage of the first regions **2*a*** will increase and thus superior electrical insulating property will be achieved.

Here, the values of $I_{Fe2SiO4}/I_{Fe}$ and $I_{Fe2O3}/I_{Fe}$ are measured and calculated according to the procedure below. First, if the magnetic base body 10 is free from surface parts whose material is different from that of the interior, such as resin or other foreign material, and if the surface is flat, then the target region for measurement is set within the flat surface. If, on the other hand, the magnetic base body 10 has any foreign material on its surface or the surface has no flat part of sufficient area, then a flat surface is exposed by polishing, cutting, etc., and the target region for measurement is set within the obtained flat surface. Next, in the target region for measurement, X-ray diffraction measurement is performed with an X-ray diffraction system (manufactured by Rigaku Corporation, RINT-2500HK) using the CuKα ray as a light source, under the conditions of 50 kV in applied voltage and 1°/min in scan speed, and in a range of 10°≤2θ≤60°. It should be noted that, if the aforementioned X-ray diffraction system is difficult to access, other systems having a similar level of measurement precision may be used. Next, the measured results are output as pairs of numeric values including the values at 2θ and values of corresponding diffraction line intensities, and from the numerical values, the maximum values of diffraction line intensities in the ranges of 43.8°≤2θ≤45.2°, 30.8°≤2θ≤32.2° and 33.0°≤2θ≤34.4° are read and used as $I_{Fe}$, $I_{Fe2SiO4}$, and $I_{Fe2O3}$, respectively. Lastly, the values of $I_{Fe2SiO4}/I_{Fe}$ and $I_{Fe2O3}/I_{Fe}$ are calculated from the read values of $I_{Fe}$, $I_{Fe2SiO4}$ and $I_{Fe2O3}$.

[Method for Manufacturing Magnetic Base Body]

The magnetic base body pertaining to the first aspect may be manufactured by: mixing a resin with a metal magnetic powder constituted by metal magnetic grains which contain Fe as an essential component and whose total content of Fe, and Si as an optional component, is 99% by mass or higher, to obtain a mixture; compacting the mixture into a compact; degreasing the compact in an oxygen-containing atmosphere whose oxygen concentration is lower than that in air; and heat-treating the degreased compact in an inert atmosphere where oxygen is virtually nonexistent.

The metal magnetic powder used is constituted by metal magnetic grains which contain Fe as an essential component and whose total content of Fe, and Si as an optional component, is 99% by mass or higher. A preferred content of each of the aforementioned elements in the metal magnetic grains is similar to that in the metal magnetic grains constituting the aforementioned magnetic base body. Also, as the metal magnetic powder is constituted by metal magnetic grains whose total content of Fe and Si is 99% by mass or higher, a sufficient amount of Fe oxides will generate on the surface of the metal magnetic grains through the degreasing treatment mentioned below, to permit generation of fayalite ($Fe_2SiO_4$) through the subsequent heat treatment. From the viewpoint of allowing for sufficient generation of fayalite, preferably the metal magnetic powder is constituted by metal magnetic grains that contain Fe by 93% by mass or more and Si by 1% by mass or more, where the mass percentage of elements other than Fe and Si is lower than that of Si.

The metal magnetic powder may contain two or more types of metal magnetic grains having different compositions. By adjusting the compounding percentages of metal magnetic grains having different compositions, magnetic properties, electrical insulating property, and mechanical strength of the magnetic base body to be obtained can be adjusted.

The grain size of the metal magnetic powder used is not limited in any way and, for example, its average grain size (median size ($D_{50}$)) as calculated from the granularity distribution measured on volume basis may be 0.5 μm to 30 μm. Preferably the average grain size is 1 μm to 10 μm. This average grain size may be measured using a granularity distribution measurement system utilizing the laser diffraction/scattering method, for example.

The metal magnetic powder may be such that the surface of its metal magnetic grains is coated with an Si-containing substance. When metal magnetic grains coated with an Si-containing substance are used as a metal magnetic powder, a magnetic base body having improved electrical insulating property between the grains can be formed, which contributes to improvement of coil component reliability.

The resin mixed with the metal magnetic powder is not limited in any way so long as it can bond the metal magnetic powder grains together into a shape and retain the shape, and will also volatilize without leaving carbon content, etc., behind in the degreasing (binder removal) process mentioned below. Examples include acrylic resins, butyral resins, vinyl resins, etc., whose decomposition temperature is 500° C. or lower. Also, a lubricant, representative examples of which include stearic acid or salt thereof, phosphoric acid or salt thereof, and boric acid or salt thereof, may be used together with the resin. The additive quantity of the resin and/or lubricant should be determined as deemed appropriate in consideration of the formability, shape retainability, etc., such as 0.1 parts by mass or more but no more than 5 parts by mass relative to 100 parts by mass of the metal magnetic powder, for example.

The method for compacting the mixture of the metal magnetic powder and resin is not limited in any way and, for example, a method may be employed whereby the mixture is supplied into dies or other molds and shaped by applying pressure via a press, etc., after which the resin is cured, to produce a compact. Besides the above, a method of stacking and pressure-bonding green sheets containing the metal magnetic powder and resin may also be adopted.

When obtaining a compact through press forming using dies, etc., the press conditions should be determined as deemed appropriate according to the types of the metal magnetic powder and resin to be mixed therewith, and compounding ratio thereof, etc. One example of press tonnage is 5 tons/$cm^2$ or higher but no higher than 10 tons/$cm^2$. When the press tonnage is at or above the lower-limit value, a compact of high fill rate can be obtained. When the press tonnage is at or below the upper-limit value, on the other hand, even pre-coated metal magnetic grains can be formed in a manner inhibiting damage to the coating.

When obtaining a compact by stacking and pressure-bonding green sheets, a method may be adopted whereby the individual green sheets are stacked up using a suction transfer machine, etc., and then thermally bonded using a press machine. To obtain multiple coil components from the pressure-bonded laminate body, the laminate body may be diced using a dicing machine, laser cutting machine, or other cutting machine.

In this case, green sheets are typically manufactured by applying a slurry containing the metal magnetic powder and a binder on the surface of plastic films or other base films using a doctor blade, die coater, or other coating machine, and then drying the slurry. The binder used is not limited in any way so long as it can compact the metal magnetic powder into a sheet shape and retain the shape, and will also volatilize, when heated, without leaving carbon content, etc., behind. Examples include polyvinyl butyral and other polyvinyl acetal resins, etc. The solvent with which to prepare the slurry is not limited in any way, either, and butyl carbitol or other glycol ether, etc., may be used. The content of each component in the slurry may be adjusted as deemed appropriate according to the adopted method for forming green sheets, thickness of the green sheets to be prepared, and so on.

In the degreasing treatment, the compact is heated in an oxygen-containing atmosphere whose oxygen concentration is lower than that in air, to let the resin volatilize through oxidation. At this time, Fe contained in the metal magnetic grains in the compact is also oxidized to generate Fe-rich oxides on the surface of the grains. Also, if the metal magnetic grains contain Cr, Al, or other metal element that oxidizes more easily than Fe by an amount corresponding to 1% by mass or less, oxidation of such metal element leads to generation of passive oxides, and consequently oxidation of Fe is inhibited appropriately. If a metal magnetic powder whose metal magnetic grains are coated with an Si-containing substance is used, Fe-rich oxides generate on the surface of the coated parts that contain Si derived from the Si-containing substance. The conditions for degreasing treatment are not limited in any way so long as the majority of the binder can be oxidized and removed while inhibiting excessive oxidation of the metal magnetic grains in the compact. One example is to perform degreasing treatment at a temperature of 300° C. or higher but no higher than 350° C. for a period of 2 hours or longer but no longer than 4 hours, in an atmosphere of 5000 ppm or higher but no higher than 10000 ppm in oxygen concentration.

The degreased compact is heat-treated in an inert atmosphere where oxygen is virtually nonexistent. If the metal magnetic grains in the compact contain Si, at this time the Si diffuses to the surface and reacts with the Fe-rich oxides generated by the degreasing treatment, to cause fayalite ($Fe_2SiO_4$) to generate. Also, depending on the heat treatment conditions, regions (first regions) where the Si concentration is markedly higher than the concentrations of other elements generate between the fayalite and metal magnetic grains. If a metal magnetic powder whose metal magnetic grains are coated with an Si-containing substance is used, the coated parts that contain Si derived from the Si-containing substance react with the Fe-rich oxides generated on their surface by the degreasing treatment, to cause fayalite ($Fe_2SiO_4$) to generate. Also, regions (first regions) where the Si concentration is markedly higher than the concentrations of other elements due to the coated parts that contain Si generate between the fayalite and metal magnetic grains. The inert atmosphere may be a nitrogen gas atmosphere, noble gas atmosphere, or vacuum atmosphere. In this Specification, "inert atmosphere" refers to an atmosphere whose oxygen concentration is equal to or lower than the levels in gases normally obtained as inert gases ($N_2$ gas and noble gases), where this oxygen concentration is generally under 5 ppm. Also, the oxygen concentration in the heat treatment atmosphere may be brought to under 3 ppm by optimizing the purity of the inert gas, structure of the heat treatment system, deoxidation conditions prior to heat treatment, etc.

The temperature and period of heat treatment are not limited in any way so long as fayalite will generate between the metal magnetic grains and neck growth of the metal magnetic grains will not occur. One example is to perform heat treatment at a temperature of 750° C. or higher but no higher than 850° C. for 30 minutes or longer but within 3 hours. The higher the heat treatment temperature, the further the diffusion of Si to the metal magnetic grain surface is promoted, and therefore fayalite can be generated between the metal grains by a shorter period of heat treatment. Also, the longer the heat treatment period, the further the amount of Si diffusing to the metal magnetic grain surface increases, and therefore fayalite can be generated between the metal grains even at a lower heat treatment temperature. On the other hand, the lower the heat treatment temperature and shorter the heat treatment period, the further the metal magnetic grains are inhibited from the occurrence of neck growth. This means that, when performing heat treatment, its temperature and period should be determined by considering the balance between promoting the generation of fayalite and inhibiting the metal magnetic grains from the occurrence of neck growth.

The aforementioned degreasing treatment and heat treatment may be performed successively using a single heat treatment system capable of switching the atmosphere and temperature settings, or intermittently using two or more different heat treatment systems.

[Coil Component]

The coil component 100 pertaining to the second aspect of the present invention (hereinafter also referred to simply as "second aspect") comprises the magnetic base body 10 pertaining to the aforementioned first aspect and a conductor 20 placed inside or on the surface of the magnetic base body 10, as illustrated in FIGS. 4A to 7.

The material, shape and placement of the conductor 20 are not limited in any way and should be determined as deemed appropriate according to the required properties. Examples of materials include silver, copper, and alloys thereof, etc. Additionally, examples of shapes include straight, meandering, planar-coiled, helical, etc. Furthermore, examples of placements include one where a sheathed conductive wire representing the conductor 20 is wound around the magnetic base body 10, one where the conductor 20 having any of various shapes is embedded into the magnetic base body 10, and the like.

Figure 4A:
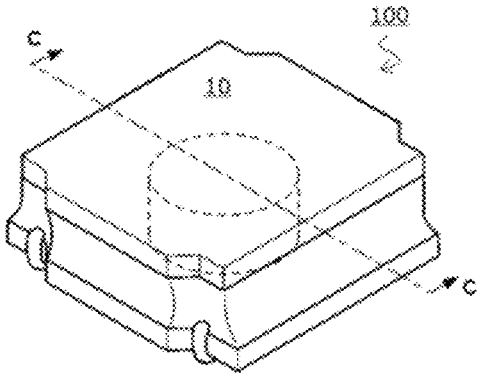
FIGS. 4A and 4B are explanation drawings of an example of structure of a wound coil component among other coil components that correspond to the coil component pertaining to the second aspect of the present invention.
Figure 4B:
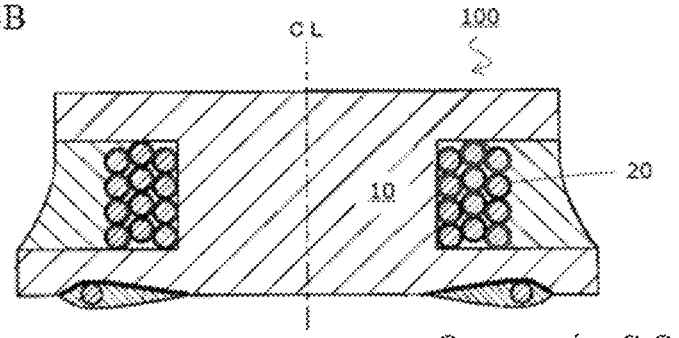
Figure 5:
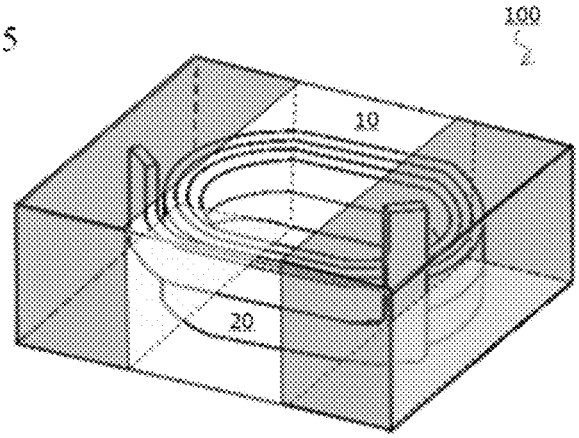
FIG. 5 is an explanation drawing of an example of structure of a composite coil component among other coil components that correspond the coil component pertaining to the second aspect of the present invention.
Figure 6A:
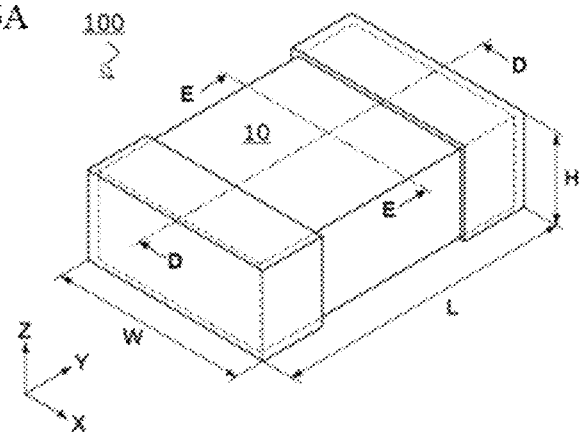
FIGS. 6A and 6B are explanation drawings of an example of the structure of a multilayer coil component among other coil components that correspond to the coil component pertaining to the second aspect of the present invention.
Figure 6B:
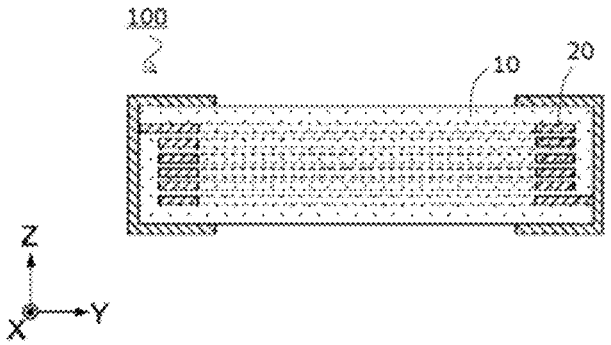
Figure 7:
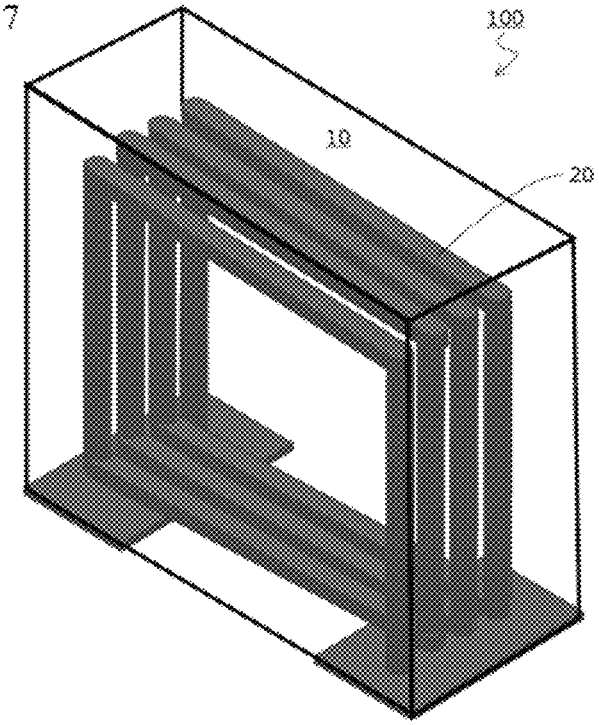
FIG. 7 is an explanation drawing of an example of structure of a thin-film coil component among other coil components that correspond the coil component pertaining to the second aspect of the present invention.

As for the shape and structure of the second aspect, examples include the wound coil component shown in FIGS. 4A and 4B, composite coil component shown in FIG. 5, multilayer coil component shown in FIGS. 6A and 6B, thin-film coil component shown in FIG. 7, and the like.

The second aspect provides a low-loss coil component resistant to magnetic saturation under electrical current. This is not only because the magnetic base body 10 is constituted by the metal magnetic grains 1 resistant to magnetic saturation, but also because the oxide layers 2 exhibiting excellent electrical insulating property are disposed between the metal magnetic grains 1 to keep current from flowing easily between the metal magnetic grains 1.

[Method for Manufacturing Coil Component 1]

The coil component pertaining to the aforementioned second aspect may be manufactured by placing a conductor on the surface of the magnetic base body pertaining to the first aspect. Examples of specific methods for placement include a method of winding a sheathed conductive wire around the magnetic base body, and a method of placing a precursor to a conductor on the surface of the magnetic base body by printing or otherwise applying a conductor paste, followed by a baking process using a sintering furnace or other heating system.

[Method for Manufacturing Coil Component 2]

Also, the coil component pertaining to the second aspect may also be manufactured through simultaneous forming of the magnetic base body pertaining to the first aspect and a conductor by: mixing a resin with a metal magnetic powder constituted by metal magnetic grains containing Fe, and Si as an optional component, to obtain a mixture; compacting the mixture together with a conductor or precursor thereto into a compact having the conductor or precursor thereto placed inside; degreasing the compact in an atmosphere whose oxygen concentration is lower than that in air; and heat-treating the degreased compact in an inert atmosphere where oxygen is virtually nonexistent.

The metal magnetic powder used herein, and resin mixed therewith, are the same as those used in the manufacture of the magnetic base body pertaining to the aforementioned first aspect, and therefore not explained. Additionally, with respect to the method for compacting the mixture of the metal magnetic powder and resin, press-forming or a method of stacking and pressure-bonding green sheets may be adopted, just like under the method for manufacturing the magnetic base body pertaining to the first aspect.

The compact having the conductor or precursor thereto placed inside is obtained, if press forming is adopted as the compacting method, by a method of filling the mixture of the metal magnetic powder and resin inside dies in which the conductor or precursor thereto has been placed beforehand, followed by pressing. Also, when a method of stacking and pressure-bonding green sheets is adopted as the compacting method, the compact is obtained by placing the precursor to conductor on green sheets by printing or otherwise applying a conductor paste, and then stacking and pressure-bonding the green sheets. Here, "conductor" refers to something that functions directly as a conductive path in a coil component, while "precursor to conductor" refers to something that contains a binder resin, etc., in addition to a conductive material that will form a conductor in a coil component, and becomes a conductor when heat-treated.

When placing the precursor to conductor using a conductor paste, the conductor paste used may be one containing a conductor powder and an organic vehicle. For the conductor powder, a powder of silver, copper, or alloy thereof, etc., is used. The grain size of the conductor powder is not limited in any way, but a powder whose average grain size (median diameter ($D_{50}$)) as calculated from the granularity distribution measured on volume basis is 1 μm to 10 μm is used, for example. The composition of the organic vehicle should be determined by considering the compatibility with the binder contained in the green sheets. One example is an organic vehicle obtained by dissolving or swelling polyvinyl butyral (PVB) or other polyvinyl acetal resin in butyl carbitol or other glycol ether-based solvent. The compounding ratios of the conductor powder and organic vehicle in the conductor paste may be adjusted as deemed appropriate according to the paste viscosity suitable for the printer used, film thickness of the conductor patterns to be formed, and so on.

The conditions for the degreasing treatment and heat treatment performed on the compact having the conductor or precursor thereto placed inside, are the same as the conditions applicable in the manufacture of the magnetic base body pertaining to the aforementioned first aspect, and therefore not explained.

[Circuit Board]

The circuit board pertaining to the third aspect of the present invention (hereinafter also referred to simply as "third aspect") is a circuit board on which the coil component pertaining to the aforementioned second aspect is mounted.

The structure, etc., of the circuit board are not limited, and any circuit board suitable for the purpose may be adopted.

The third aspect reduces loss by using the coil component pertaining to the second aspect.

EXAMPLES

The present invention is explained more specifically below using examples; it should be noted, however, that the present invention is not limited to the examples.

Example 1

(Production of Magnetic Base Bodies)

As a metal magnetic powder, one constituted by metal magnetic grains whose ratios by mass of contained elements are 93Fe-6.5Si—0.5Cr, and having an average grain size of approx. 4 μm, was prepared. This metal magnetic powder was mixed with a polyvinyl butyral (PVB)-based binder resin and a dispersion medium, to prepare a slurry. The obtained slurry was coated on PET films according to the doctor blade method and then dried, to obtain green sheets. These green sheets were stacked and then pressure-bonded under a pressure of 7 tons/cm$^2$, into compacts. The obtained compacts were processed into strip, disk, and ring shapes, respectively, and then degreased at 300° C. for 2 hours in a nitrogen-oxygen mixed atmosphere adjusted to an oxygen concentration of 7500 ppm. The degreased compacts were heat-treated at 800° C. for 1 hour in a nitrogen atmosphere (oxygen concentration: approx. 3 ppm), to obtain the test magnetic base bodies pertaining to Example 1.

(X-Ray Diffraction Measurement of Magnetic Base Bodies)

X-ray diffraction measurement using the CuKα ray was performed on the surface of the obtained test magnetic base bodies according to the aforementioned method, and based on the results, the ratio ($I_{Fe2SiO4}/I_{Fe}$) of the strongest diffraction line intensity ($I_{Fe2SiO4}$) observed in a range of $30.8° \leq 2\theta \leq 32.2°$ to the strongest diffraction line intensity ($I_{Fe}$) observed in a range of $43.8° \leq 2\theta \leq 45.2°$, as well as the ratio ($I_{Fe2O3}/I_{Fe}$) of the strongest diffraction line intensity ($I_{Fe2O3}$) observed in a range of $33.0° \leq 2\theta \leq 34.4°$ to the $I_{Fe}$, were calculated, respectively. As a result, $I_{Fe2SiO4}/I_{Fe}$ was 0.0027, while $I_{Fe2O3}/I_{Fe}$ was lower than 0.0010.

(Confirmation of Presence or Absence of First Regions and Second Regions in Oxide Layers)

For the obtained test magnetic base bodies, the distribution of molar ratios of Si to Fe (Si/Fe) in the oxide layers was measured and calculated according to the aforementioned method, to confirm presence or absence of first regions and second regions in the oxide layers. The results confirmed that, in the oxide layers, first regions were present in a manner sandwiching second regions. The maximum value of Si/Fe in the oxide layers (first regions) was 3.5, while the minimum value of Si/Fe in the oxide layers (second regions) was 0.61.

(Transverse Strength Measurement of Magnetic Base Body)

Three-point bending test was performed on the obtained strip-shaped test magnetic base body using a bending tester (manufactured by IMADA Co., Ltd., FSA-0.5K2-100N) according to JIS R 1601, and the obtained bending strength was used as transverse strength. As a result, the transverse strength was 71 MPa.

(Volume Resistivity Measurement of Magnetic Base Body)

The obtained disk-shaped test magnetic base body was measured for volume resistivity to confirm electrical insulating property. First, an Ag paste was applied on the front and back sides (two opposing faces having the largest areas) of the test magnetic base body of 8 mm in diameter and 0.5 mm in thickness, and then baked, to form electrodes. Next, the electrical resistance value of this test magnetic base body was measured using a resistance meter (manufactured by Hioki E. E. Corporation, RM3544), and the volume resistivity was calculated from the obtained electrical resistance value as well as from the electrode areas and thickness of the test magnetic base body. The obtained volume resistivity was $5.0 \times 10^7$ Ω·cm.

(Production of Coil Component and Specific Magnetic Permeability Measurement of Magnetic Base Body)

A conductive wire was wound 20 turns around the obtained ring-shaped test magnetic base body, to produce a toroidal-shaped coil component. This coil component was connected to an RF impedance/material analyzer (manufactured by Keysight Technologies Inc., E4991A) to measure the specific magnetic permeability of the test magnetic base body at room temperature under the conditions of 500 mV in OSC level and 10 MHz in frequency. The obtained specific magnetic permeability was 33.

Examples 2 to 5

(Production of Magnetic Base Bodies)

The test magnetic base bodies pertaining to Examples 2 to 5 were produced according to the same method in Example 1, except that the metal magnetic powder was changed to one constituted by metal magnetic grains whose ratios by mass of contained elements were 94Fe-5.5Si—0.5Cr (Example 2), one constituted by metal magnetic grains whose ratios by mass of contained elements were 95Fe-4.5Si—0.5Cr (Example 3), one constituted by metal magnetic grains whose ratios by mass of contained elements were 96Fe-3.5Si—0.5Cr (Example 4), and one constituted by metal magnetic grains whose ratios by mass of contained elements were 97Fe-2.5Si—0.5Cr (Example 5), respectively.

(X-Ray Diffraction Measurement of Magnetic Base Bodies)

For each of the obtained test magnetic base bodies, the values of $I_{Fe2SiO4}/I_{Fe}$ and $I_{Fe2O3}/I_{Fe}$ were calculated according to the same method in Example 1. As a result, $I_{Fe2O3}/I_{Fe}$ was lower than 0.0010 in all of the Examples. Also, $I_{Fe2SiO4}/I_{Fe}$ was 0.0030 in Example 2, 0.0032 in Example 3, 0.0035 in Example 4, and 0.0036 in Example 5.

(Confirmation of Presence or Absence of First Regions and Second Regions in Oxide Layers)

For each of the obtained test magnetic base bodies, the distribution of molar ratios of Si to Fe (Si/Fe) in the oxide layers was measured and calculated according to the same method in Example 1, to confirm presence or absence of first regions and second regions in the oxide layers. The results confirmed that, with the test magnetic base bodies pertaining to Examples 2 to 4, first regions were present in a manner sandwiching second regions in the oxide layers. With these test magnetic base bodies, the maximum value of Si/Fe in the oxide layers (first regions) was 3.4 in Example 2, 3.1 in Example 3, and 2.6 in Example 4. Also, the minimum value of Si/Fe in the oxide layers (second regions) was 0.60 in Example 2, 0.56 in Example 3, and 0.54 in Example 4. With the test magnetic bodies pertaining to Example 5, on the other hand, the maximum value and minimum value of Si/Fe in the oxide layers were 0.82 and 0.42, respectively, failing to confirm presence of first regions.

(Transverse Strength and Volume Resistivity Measurements of Magnetic Base Bodies)

For each of the obtained test magnetic base bodies, the transverse strength and volume resistivity were measured and calculated according to the same methods in Example 1. As a result, the transverse strength was 75 MPa and volume resistivity was $5.0 \times 10^7$ Ω·cm in Example 2, transverse strength was 83 MPa and volume resistivity was $4.0 \times 10^7$ Ω·cm in Example 3, transverse strength was 82 MPa and volume resistivity was $2.0 \times 10^7$ Ω·cm in Example 4, and transverse strength was 84 MPa and volume resistivity was $2.0 \times 10^5$ Ω·cm in Example 5.

(Production of Coil Components and Specific Magnetic Permeability Measurement of Magnetic Base Bodies)

From each of the obtained magnetic base bodies, a coil component was produced according to the same method in Example 1 and measured for specific magnetic permeability. The obtained specific magnetic permeabilities were 34 in Example 2, 34 in Example 3, 33 in Example 4, and 32 in Example 5.

Example 6

(Production of Magnetic Base Bodies)

The test magnetic base bodies pertaining to Example 6 were produced according to the same method in Example 1, except that the metal magnetic powder was changed to one prepared by mixing the metal magnetic powders used in Examples 4 and 5 at a ratio by mass of 1:1.

(X-ray Diffraction Measurement of Magnetic Base Bodies)

For the obtained test magnetic base bodies, the values of $I_{FeSiO4}/I_{Fe}$ and $I_{Fe2O3}/I_{Fe}$ were calculated according to the same method in Example 1. As a result, $I_{FeSiO4}/I_{Fe}$ was 0.0032 and $I_{Fe2O3}/I_{Fe}$ was lower than 0.0010.

(Confirmation of Presence or Absence of First Regions and Second Regions in Oxide Layers)

For the obtained test magnetic base bodies, the distribution of molar ratios of Si to Fe (Si/Fe) in the oxide layers was measured and calculated according to the same method in Example 1, to confirm presence or absence of first regions and second regions in the oxide layers. The results confirmed that first regions and second regions were present in the oxide layers. The maximum value of Si/Fe in the oxide layers (first regions) was 2.5, while the minimum value of Si/Fe in the oxide layers (second regions) was 0.44.

(Transverse Strength and Volume Resistivity Measurements of Magnetic Base Bodies)

For the obtained test magnetic base bodies, the transverse strength and volume resistivity were measured and calculated according to the same methods in Example 1. As a result, the transverse strength was 81 MPa and volume resistivity was $1.0\times10^7$ Ω·cm.

(Production of Coil Component and Specific Magnetic Permeability Measurement of Magnetic Base Body)

From the obtained magnetic base bodies, a coil component was produced according to the same method in Example 1 and measured for specific magnetic permeability. The obtained specific magnetic permeability was 33.

Comparative Example 1

(Production of Magnetic Base Bodies)

The test magnetic base bodies pertaining to Comparative Example 1 were obtained according to the same method in Example 1, except that the metal magnetic powder was changed to one constituted by metal magnetic grains whose ratios by mass of contained elements were 95Fe-3.5Si-1.5Cr, and that the atmosphere for degreasing treatment was changed to air.

(X-Ray Diffraction Measurement of Magnetic Base Bodies)

For the obtained test magnetic base bodies, the values of $I_{FeSiO4}/I_{Fe}$ and $I_{Fe2O3}/I_{Fe}$ were calculated according to the same method in Example 1. As a result, $I_{FeSiO4}/I_{Fe}$ was lower than 0.0010 and $I_{Fe2O3}/I_{Fe}$ was 0.0239.

(Transverse Strength and Volume Resistivity Measurements of Magnetic Base Bodies)

For the obtained test magnetic base bodies, the transverse strength and volume resistivity were measured and calculated according to the same methods in Example 1. As a result, the transverse strength was 72 MPa and volume resistivity was $2.0\times10^3$ Ω·cm.

(Production of Coil Component and Specific Magnetic Permeability Measurement of Magnetic Base Body)

From the obtained magnetic base bodies, a coil component was produced according to the same method in Example 1 and measured for specific magnetic permeability. The obtained specific magnetic permeability was 34.

The manufacturing conditions of the magnetic base bodies pertaining to the Examples and Comparative Example explained above, and properties of the obtained magnetic base bodies, are summarized in Tables 1 and 2, respectively.

TABLE 1

| | Composition of metal magnetic grains (powder) | Degreasing treatment atmosphere | Degreasing temperature [° C.] | Heat treatment atmosphere | Heat treatment temperature [° C.] |
|---|---|---|---|---|---|
| Example 1 | 93Fe—6.5Si—0.5Cr | 7500 ppm $O_2$ | 300 | $N_2$ | 800 |
| Example 2 | 94Fe—5.5Si—0.5Cr | | | (<3 ppm $O_2$) | |
| Example 3 | 95Fe—4.5Si—0.5Cr | | | | |
| Example 4 | 96Fe—3.5Si—0.5Cr | | | | |
| Example 5 | 97Fe—2.5Si—0.5Cr | | | | |
| Example 6 | 96Fe—3.5Si—0.5Cr + 97Fe—2.5Si—0.5Cr (1:1) | | | | |
| Comparative Example 1 | 95Fe—3.5Si—1.5Cr | Air | | | |

TABLE 2

| | $I_{(Fe2SiO4)}/I_{(Fe)}$ | $I_{(Fe2O3)}/I_{(Fe)}$ | Maximum value of Si/Fe in oxide layers | Minimum value of Si/Fe in oxide layers | Transverse strength [MPa] | Volume resistivity [Ω · cm] | Specific magnetic permeability at 10 MHz |
|---|---|---|---|---|---|---|---|
| Example 1 | 0.0027 | <0.0010 | 3.5 | 0.61 | 71 | $5.0 \times 10^7$ | 33 |
| Example 2 | 0.0030 | | 3.4 | 0.60 | 75 | $5.0 \times 10^7$ | 34 |
| Example 3 | 0.0032 | | 3.1 | 0.56 | 83 | $4.0 \times 10^7$ | 34 |
| Example 4 | 0.0035 | | 2.6 | 0.54 | 82 | $2.0 \times 10^7$ | 33 |
| Example 5 | 0.0036 | | 0.82 | 0.42 | 84 | $2.0 \times 10^5$ | 32 |
| Example 6 | 0.0032 | | 2.5 | 0.44 | 81 | $1.0 \times 10^7$ | 33 |
| Comparative Example 1 | <0.0010 | 0.0239 | Not measured | Not measured | 72 | $2.0 \times 10^3$ | 34 |

From the above results, it can be argued that the magnetic base bodies formed by metal magnetic grains containing Fe and Si, where the total content of Fe and Si was 99% by mass or higher, as well as by oxide layers present between the metal magnetic grains, wherein the ratio ($I_{Fe2SiO4}/I_{Fe}$) of the strongest diffraction line intensity ($I_{Fe2SiO4}$) observed in a range of 30.8°≤2θ≤32.2° to the strongest diffraction line intensity ($I_{Fe}$) observed in a range of 43.8°≤2θ≤45.2° in X-ray diffraction measurement using the CuKα ray was 0.0020 or higher, while the ratio ($I_{Fe2O3}/I_{Fe}$) of the strongest diffraction line intensity ($I_{Fe2O3}$) observed in a range of 33.0°≤2θ≤34.4° to the $I_{Fe}$ in X-ray diffraction measurement using the CuKα ray was lower than 0.0010, manifested excellent electrical insulating property. Additionally, the magnetic base bodies pertaining to Examples 3 to 6 whose value of $I_{Fe2SiO4}/I_{Fe}$ was 0.0032 or greater all had transverse strength exceeding 80 MPa, and therefore it can be argued that the magnetic base bodies whose value of the $I_{Fe2SiO4}/I_{Fe}$ was 0.0032 or greater exhibited excellent mechanical strength, as well. Furthermore, the magnetic base bodies pertaining to Examples 1 to 4 and 6 which had first regions and second regions present in the oxide layers all had volume resistivity of $1.0\times10^7$ Ω·cm or higher, and therefore it can be argued that the magnetic base bodies having first regions and second regions present in the oxide layers exhibited superior electrical insulating property. In particular, the magnetic base bodies pertaining to Examples 1 to 3 whose first regions had parts where Si/Fe was 3 or higher exhibited exceptional electrical insulating property. Also, the magnetic base bodies pertaining to Example 4 in which first regions were present in a manner sandwiching second regions had similar levels of Si/Fe, but higher volume resistivity compared to the magnetic base bodies pertaining to Example 6 in which first regions did not sandwich second regions, and therefore it can be argued that the magnetic base bodies having first regions present in a manner sandwiching second regions in the oxide layers exhibited even greater electrical insulating property.

INDUSTRIAL APPLICABILITY

According to the present invention, a magnetic base body constituted by metal magnetic grains and offering excellent electrical insulating property can be provided. This magnetic base body comprises metal magnetic grains resistant to magnetic saturation, and thus when made into a coil component, allows high current to flow through it. Additionally, the oxide layers present between the metal magnetic grains have good electrical insulating property, and consequently high volume resistivity, and thus keep current from flowing through them easily, which means that, when the magnetic base body is made into a coil component, its energy loss becomes low. In light of the above, the present invention is useful in that it permits performance enhancement and size reduction of coil components.

We claim:

1. A magnetic base body, comprising:

metal magnetic grains containing Fe, and Si as an optional component, where a total content of the Fe and Si is 99% by mass or higher; and oxide layers present between the metal magnetic grains;

wherein a ratio ($I_{Fe2SiO4}/I_{Fe}$) of a strongest diffraction line intensity ($I_{Fe2SiO4}$) observed in a range of 30.8°≤2θ≤32.2° to a strongest diffraction line intensity ($I_{Fe}$) observed in a range of 43.8°≤2θ≤45.2° in X-ray diffraction measurement using a CuKα ray is 0.0020 or higher; and a ratio ($I_{Fe2O3}/I_{Fe}$) of a strongest diffraction line intensity ($I_{Fe2O3}$) observed in a range of 33.0°≤2θ≤34.4° to the $I_{Fe}$ in X-ray diffraction measurement using a CuKα ray is lower than 0.0010.

2. The magnetic base body according to claim 1, wherein the oxide layers have:

first regions where a molar ratio of Si to Fe, or (Si/Fe), is 2 or higher; and second regions where a molar ratio (Si/Fe) is 1 or lower.

3. The magnetic base body according to claim 2, wherein the first regions are present in a manner sandwiching the second regions.

4. A coil component, comprising the magnetic base body according to claim 1, and a conductor placed inside or on a surface of the magnetic base body.

5. A circuit board on which the coil component according to claim 4 is mounted.

6. The magnetic base body according to claim 1, wherein the metal magnetic grains contain one or more metal elements that oxidize more easily than Fe by an amount corresponding to 1% by mass or less.

7. The magnetic base body according to claim 1, wherein the total content of the Fe and Si is 99.5% by mass or higher.

* * * * *